United States Patent [19]

Auxer

[11] 3,979,941

[45] Sept. 14, 1976

[54] STEERING MEANS PARTICULARLY FOR INTERNAL PIPE BENDING MANDRELS

[75] Inventor: Marvin L. Auxer, Turtlegate, Tex.

[73] Assignee: Mid-Continent Pipeline Equipment Company, Houston, Tex.

[22] Filed: July 1, 1975

[21] Appl. No.: 592,230

[52] U.S. Cl. ..... 72/466; 104/138 G

[51] Int. Cl.[2] ..... B21D 9/00

[58] Field of Search ..... 72/370, 398, 466; 269/48.1; 104/138 G; 254/134.5; 15/104.5

[56] References Cited

UNITED STATES PATENTS

| | | | |
|---|---|---|---|
| 2,638,069 | 5/1953 | Mcarns | 269/48.1 |
| 3,058,137 | 10/1962 | Doyle et al. | 254/134.5 |
| 3,109,477 | 11/1963 | Avera et al. | 269/48.1 |
| 3,547,040 | 12/1970 | Baran | 104/138 |
| 3,718,978 | 3/1973 | Van Koevering et al. | 104/138 |
| 3,734,428 | 5/1973 | Moritsovich et al. | 104/138 |
| 3,741,457 | 6/1973 | Gwin et al. | 269/48.1 |
| 3,890,905 | 6/1975 | Clavin | 254/134.5 |

*Primary Examiner*—Lowell A. Larson
*Attorney, Agent, or Firm*—Carl B. Fox, Jr.

[57] ABSTRACT

Steering means, particularly for use with internal pipe bending mandrels, wherein upper and lower driven wheels are mutually expanded against the pipe wall by an intermediate free-floating hydraulic cylinder, and wherein at least one of the upper and lower driven wheels are rotatably disposed to provide steering. The steering assembly is affixed as a support at one end of the mandrel and serves to keep the mandrel upright within the pipe.

26 Claims, 3 Drawing Figures

STEERING MEANS PARTICULARLY FOR INTERNAL PIPE BENDING MANDRELS

BACKGROUND OF THE INVENTION

Pipe bending mandrel assemblies of the type used during bending of relatively large diameter pipe used in the construction of pipe lines are heavy cumbersome pieces of equipment. The mandrels must be run internally through the pipe and therefore usually have wheel supports at each end. Drive wheels are provided for causing movement of the mandrels through the pipes. One problem frequently encountered in this connection is that the mandrels are not balanced and may be top heavy so that should the mandrel rotate or roll in one direction or the other, the rolling may continue. The wheel supports are usually provided in pairs at the bottom and top of the mandrel, and when rolling of the mandrel occurs it is extremely difficult to move it back to an upright position. The mandrel will usually be up to about 40 feet or more from the open end of the pipe, so it must be controlled remotely. This makes moving the mandrel and keeping it in upright position even more difficult.

SUMMARY OF THE INVENTION

According to the invention, a steering apparatus particularly suited for use with internal pipe bending mandrels is provided. The steering apparatus is utilized as part of the wheel carriage assembly at one end of the mandrel assembly. The steering assembly includes an upright cylindrical tube or pipe at each end of which an axially slidable tube or pipe is disposed. Each of the end pipes carries a wheel assembly, the lower pipe mounting the lower drive wheels and the upper pipe mounting the upper drive wheels. A vertically disposed free-floating hydraulic cylinder acts between the upper and lower wheel carrying pipes to expand them farther apart or to bring them closer together. When the wheels are expanded farther apart, they come into contact with the pipe wall. Operation of the wheel driving motors will cause movement of the mandrel through the pipes. One or both of the upper and lower wheel assemblies, and usually only the upper wheel assembly, is made so that the wheel axis is rotatable, by rotation of the pipe which carries it and which is disposed at the upper end of the central vertical pipe. By this rotation, the upper wheels may be steered to either side of a straight direction along the pipe in which the apparatus is disposed. The wheels are firmly in contact with the interior pipe wall so that the apparatus may be steered to maintain it in upright condition and to prevent it from rotating or rolling as it travels through the pipe. Should the mandrel or other apparatus having the steering apparatus begin to roll from the upright position, the steering wheels are turned in the proper direction to counter the roll. As the mandrel reaches its upright position, the steering wheels are returned to the straight direction to maintain the mandrel in straight upright travel.

The driven wheels of the steering assembly are preferably driven by hydraulic motors powered by pressured hydraulic fluid from a hydraulic fluid pump-reservoir system carried by the mandrel assembly. Other suitable drive motors, such as electric motors, may be used.

A principal object of the invention is to provide steering devices for use with internal pipe bending mandrels, the steering assembly also being useful in connection with the steering of other comparable apparatuses. Another object of the invention is to provide such steering assemblies which are useful in maintaining mandrel assemblies, and the like, upright when disposed within the pipe. Yet another object of the invention is to provide such steering assemblies which are economical, relatively simple and easily operated. A further object of the invention is to provide such steering assemblies which may be used to drive the mandrel assemblies, or the like, through pipes.

Other objects and advantages of the invention will appear from the following detailed description of a preferred embodiment of the invention, reference during the description being made to the accompanying drawings.

DESCRIPTION OF THE PREFERRED EMBODIMENT

Figure 1:
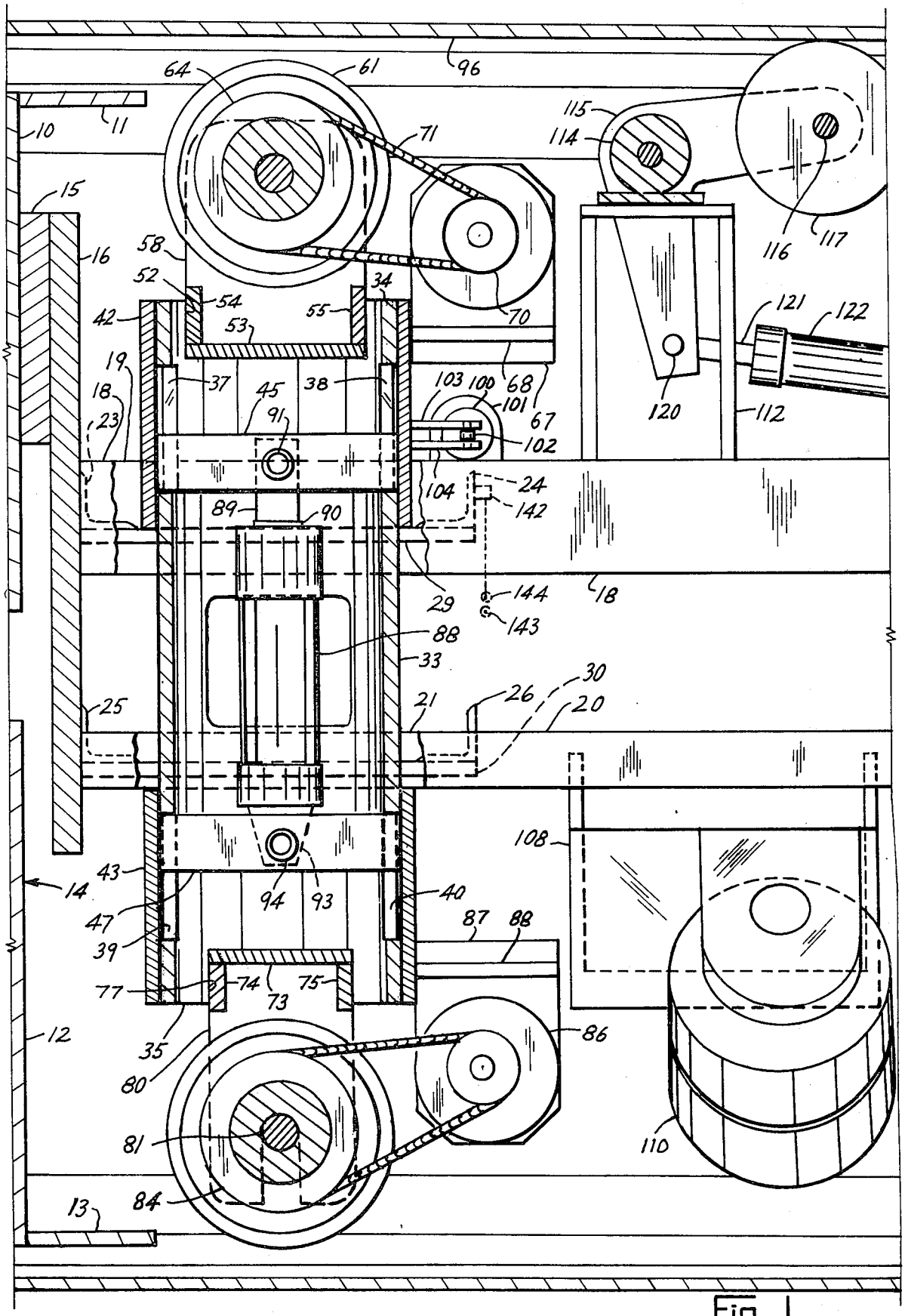
FIG. 1 is a side elevation, partly in vertical cross section, showing a preferred form of steering assembly according to the invention.
Figure 2:
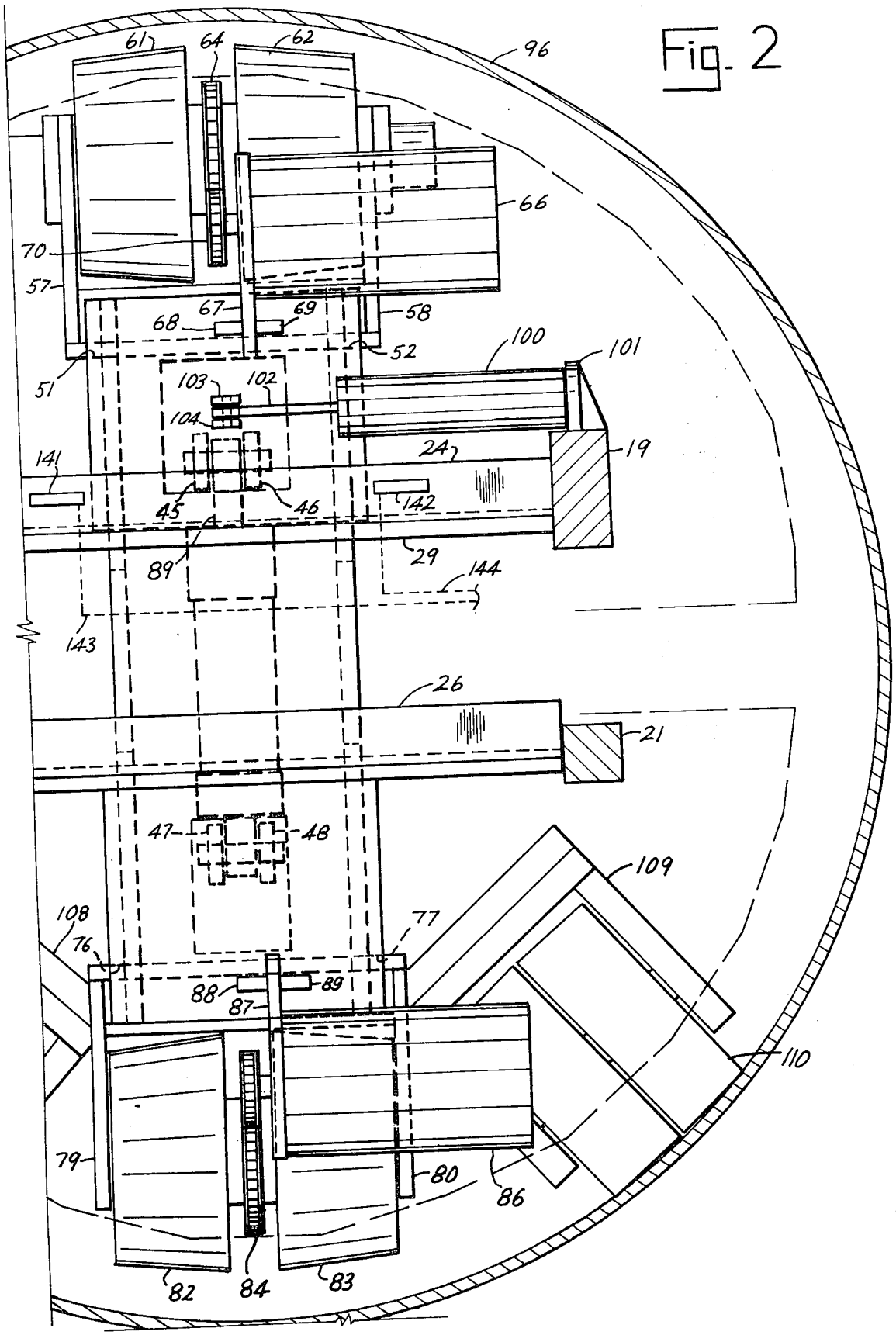
FIG. 2 is an end elevation, of the apparatus shown in FIG. 1.

Referring now to FIGS. 1 and 2 of the drawings, the elements 10, 11 and 12, 13 are end elements of an internal pipe bending mandrel 14, the remainder of the mandrel not being shown. A plate 15 affixed to element 10 has another plate 16 affixed thereto. Upper and lower parallel bars 18, 19 and 20, 21 form a framework for support of the steering assembly and of the other elements of the carriage provided for supporting the front end of the mandrel assembly. Angle members 23, 24 are welded to extend between bars 20, 21. Plates 29, 30 are affixed by welding to angle members 23, 24 and angle members 25, 26, respectively. The plates 29, 30 extend between bars 18, 19 and 20, 21.

Each plate 29, 30 has a circular opening at its center through which is closely fitted and fixed in place by welding a vertical tube or pipe 33. The upper end 34 of pipe 33 extends above plate 29, and the lower end 35 of plate 33 extends below plate 30. At its upper end, pipe 33 has opposite rectangular openings 37, 38, and at its lower end has horizontally narrower rectangular opposite openings 39, 40.

Tube or pipe sleeve 42 closely but slidably surrounds the upper portion of pipe 30 above plate 29. Tube or pipe sleeve 43 similarly surrounds the lower part of pipe 33 below plate 30. Bars 45, 46 are welded parallely across the interior of pipe 42 to extend freely through openings 37, 38. The bars 45, 46 are parallel and are spaced somewhat apart. Bars 47, 48 are similarly welded across the interior of pipe 43, extending through rectangular openings 39, 40. Each of the tubes or pipes 42, 43 may move slidably axially of pipe 33 through the heights of openings 37, 38 and 39, 40. Pipe 42 may rotate with respect to pipe 33, the width of openings 37, 38 being such that the rotation of the bars 45, 46 therein is approximately 15° each way from center. Openings 39, 40 being narrower than openings 37, 38, the bars 47, 48 and pipe 43 may rotate only slightly on pipe 33. The upper and lower ends of openings 37, 38 and 39, 40, respectively, limit the upward and downward travel of the pipes 42, 43.

Pipe 42 has opposite end recesses 51, 52 into which are welded a cross plate 53 and side plates 54, 55. These elements provide a support for vertically disposed plates 57, 58 which support the axle of wheels 61, 62. The axle supporting wheels 61, 62 has affixed thereon between the wheels a chain sprocket 64. A hyrdaulic motor 66 supported by plate 67 and brace plates 68, 69 carries on its shaft a chain sprocket 70, and a chain 71 engages around sprockets 64 and 70. Hydraulic motor 66 is a reversible motor, so that it may be used to drive the wheels 61, 62 in either rotative direction. Plates 73, 74, 75, are welded in place through end recesses 76, 77 oppositely disposed in the lower end of pipe 43. End plates 79, 80 support axle 81 carrying wheels 82, 83. A chain sprocket 84 is supported between the wheels. Hydraulic motor 86 is supported by plate 87 and brace plates 88, 89 which are welded to the side of pipe 43. Hydraulic motor 86 is reversible so that wheels 82, 83 may be driven in either rotative direction.

A hydraulic cylinder 88 has a rectangular plate 89 affixed by screws to the end of its shaft 90. Plate 89 is disposed between bars 45, 46 and is connected thereto by shaft or pin 91. The lower end of cylinder 88 has welded thereto a plate 93 which is disposed between bars 47, 48 and connected thereto by a pin or shaft 94. When hydraulic cylinder 88 is extended, bars 45, 46 push pipe 42 supporting wheels 61, 62 upwardly against the interior side of pipe wall 96. In the same way, the extension of cylinder 88 drives pipe 43 supporting wheels 82, 83 downwardly to bring the wheels against the lower side of the pipe wall 96. The cylinder 88 and pipes 42, 43 are free floating so that each pair of wheels 61, 62 and 82, 83 may move sufficiently to contact the pipe wall. The travel of the top and bottom wheels is not necessarily the same. When the wheels are in contact with the pipe as described, the wheel pressure being adjustable depending on the pressure exerted by cylinder 88, the wheels may be used to drive the steering assembly and the connected mandrel assembly lengthwise through the pipe, in either direction. Operation of the two hydraulic motors 66, 86 is controlled so that the wheels rotate at the same speeds.

A hydraulic cylinder 100 is affixed to and supported by bar 19 by a bracket 101. Shaft 102 of cylinder 100 is pivotally connected between brackets 103, 104 affixed to the front side of pipe 42. Extension of cylinder 100 rotates pipe 42 clockwise as seen from above, while retraction of cylinder 100 rotates pipe 42 counter clockwise as seen from above. Since openings 37, 38 permit approximately 15° rotation of pipe 42 in either direction from center, the wheels 61, 62 may be rotated approximately 15° from positions in line with the pipe to either side. Cylinder 100, like hydraulic motors 66 and 86 may be operated remotely from outside of the pipe. Should the mandrel assembly begin to rotate or roll within the pipe, the wheels 61 62 may be turned in the appropriate direction to steer the mandrel assembly back to its proper upright position. This may be done with travel of the mandrel assembly in either direction through the pipe.

As stated before, wheels 82, 83 may be made to be steering wheels in the same manner as shown for wheels 61, 62. But since this is not necessary to properly control the mandrel assembly position, it is usually not done.

Bars 20, 21 support brackets 108, 109 which each carry a pair of idler rollers or wheels 110. A support framework 112 supported by bars 18, 19 supports a bearing 114. A pair of L-shaped rockers 115 support shaft 116 carrying idler wheels 117, usually two in number, The lower ends of rockers 115 are connected pivotally by pin 120 to shaft 121 of hyrdaulic cylinder 122. When cylinder 122 is extended, the rockers 115 move wheels 117 away from the wall of pipe 96. When cylinder 122 is retracted, arm 115 moves wheels 117 into engagement with the pipe wall. The pressure of wheel 117 against the pipe roll may be controlled by control of the hydraulic pressure in cylinder 122. In this manner, the engagement pressure of idler wheels 110 and 117 may be adjusted to proper pressure.

Figure 3:
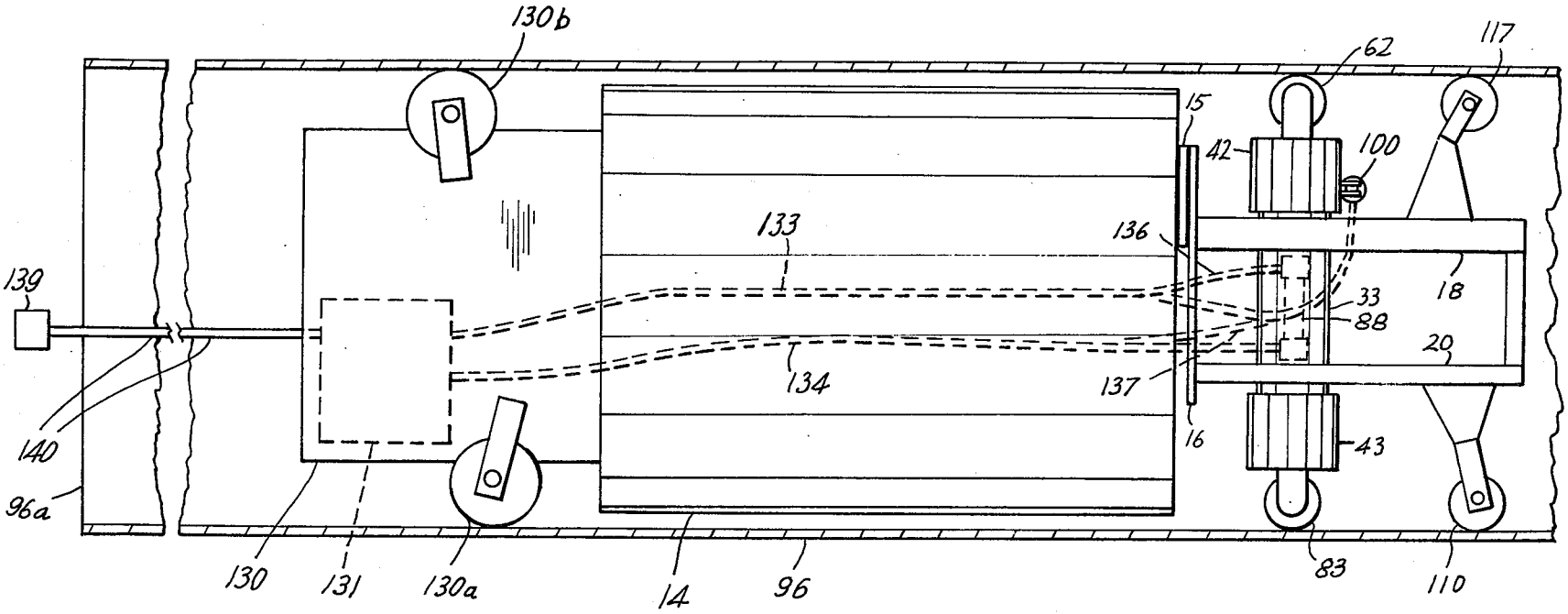
FIG. 3 is a schematic drawing showing a manner of use of the apparatus shown in FIGS. 1 and 2.

Referring now to FIG. 3 of the drawings, the steering apparatus herein described is shown schematically, assembled at one end of the internal pipe bending mandrel 14, or other similar device, inside the pipe 96. A power assembly 130 supported by wheels 130*a*, 130*b* is affixed to the lefthand end of mandrel 14, and includes a hydraulic fluid pump-reservoir assembly 131. Hydraulic fluid conduits 133, 134 extend from assembly 131 to hydraulic cylinder 88. Additional conduits 136, 137 extend to hydraulic cylinder 100. A hydraulic fluid control device 139 is connected by longidutinal element 140 to assembly 131. Device 139 may, as shown, be located beyond end 96*a* of pipe 96, outside of the pipe. Operation of device 139 controls hydraulic fluid flow through conduits 133, 134 and 136, 137, in a manner well known in the art, to control the operation of hydraulic cylinders 88 and 100. Control of the steering apparatus may in this manner be accomplished remotely from the exterior of the pipe.

Referring again to FIGS. 1 and 2, a pair of mercury switches 141, 142 are shown affixed to elements 24. These switches may instead be carried by any other frame member of the assembly. Switches 141, 142 are positioned and calibrated to sense roll of the mandrel assembly and to automatically correct the sensed roll by actuation of the steering cylinder 100 through a suitable electrical circuit. The operator may override this automatic control at control device 139. Switches 141, 142 are connected to the control circuit by suitable conductors 143, 144, respectively.

As will be understood, the invention provides a steering apparatus for use with internal pipe bending mandrels, and like equipment, which is simple yet reliable in construction and in operation. The apparatus may readily be operated from outside the pipe using hydraulic fluid pressured and supplied either from a hydraulic pumping unit of the mandrel assembly, or supplied through flexible conduits extending to the assembly from outside the pipe.

While a preferred embodiment of the invention has been described and shown in the drawings, many modifications thereof may be made by a person skilled in the art without departing from the spirit of the invention, and it is intended to protect by Letters Patent all forms of the invention falling within the scope of the following claims.

I claim:

1. Steering apparatus for a traveling device disposed in a passage, comprising body means carried by said device transverse to the passage, movable means at opposite sides of said passage engaged with said body means and slidably movable thereon toward and away from the passage wall, wheel means for engaging the passage wall carried by each said movable means, at least one of said movable means also being rotatable about an axis parallel to the direction of sliding movement thereof to alter the direction of its said wheels to provide steering of said device, and drive means connected between said movable means for moving said movable means toward and away from the passage wall.

2. The combination of claim 1, including second drive means for rotating said rotatable movable means.

3. The combination of claim 1, including drive means for at least one of said wheel means.

4. The combination of claim 3, said wheel drive means being reversable drive means.

5. The combination of claim 1, said first-named drive means comprising a free-floating hydraulic cylinder.

6. The combination of claim 5, said second drive means comprising a hydraulic cylinder.

7. The combination of claim 1, said passage having uniform circular cross sections.

8. The combination of claim 7, said passage being the passage through a pipe.

9. The combination of claim 1, said body means being of cylindrical tubular shape, said movable means each being of cylindrical tubular shape and telescopically closely yet slidably engaged with said body means at opposite ends thereof.

10. The combination of claim 9, said movable means being telescopingly engaged around said opposite ends of said body means, said body means having opposite openings therethrough within each said movable means, said movable means each having bar means internally thereacross disposed through said openings through said body means.

11. The combination of claim 10, said drive means being connected between said bar means.

12. The combination of claim 11, said drive means comprising a hydraulic cylinder; each said rotatable movable means being rotated by a hydraulic cylinder connected between said device and said rotatable movable means.

13. The combination of claim 12, said rotatable movable means being rotatable about 15° to each side of the straight wheel position of said rotatable movable means.

14. Apparatus for steering a traveling device through a pipe to maintain the traveling device in an upright position, comprising driven upper wheel means extendable upwardly to engage the pipe and retractable downwardly away from the pipe, driven lower wheel means extendable downwardly to engage the pipe and retractable upwardly away from the pipe, drive means connected between said upper and lower wheel means to simultaneously extend and retract said upper and lower wheel means, and means for rotating at least one of said upper and lower wheel means from the straight ahead position of said wheel means to correct unwanted roll of said traveling device within said pipe.

15. The combination of claim 14, said drive means and said means for rotating at least one of said upper and lower wheel means each comprising hydraulic cylinder means.

16. The combination of claim 15, said hydraulic cylinder means for rotating at least one of said upper and lower wheel means being connected to bracket means extending outwardly of the wheel means.

17. The combination of claim 14, including a cylindrical tubular body supported by said traveling device diametrically within said pipe, each of said upper and lower wheel means including a cylindrical sleeve telescopically slidably engaged with an end of said tubular body.

18. The combination of claim 17, said tubular body having opposite side openings at each of its ends within said sleeves of said upper and lower wheel means, and including bar means diametrically across said sleeves received through said openings.

19. The combination of claim 18, said drive means being connected between said bar means.

20. The combination of claim 19, the widths of said openings limiting the rotation of said bar means and said wheel means.

21. The combination of claim 20, said traveling device comprising an internal pipe bending mandrel.

22. The combination of claim 21, said mandrel including hydraulic fluid supply means, said hydraulic cylinders being operated by fluid supplied by said hydraulic fluid supply means.

23. The combination of claim 22, including means for operating said driven wheel means and said hydraulic cylinders remotely from outside the pipe.

24. The combination of claim 14, including means for sensing roll of said traveling device with respect to the pipe and for automatically actuating said means for rotating at least one of said upper and lower wheel means to cause correction of said roll.

25. The combination of claim 15, including means for sensing roll of said traveling device with respect to the pipe and for automatically actuating said means for rotating at least one of said upper and lower wheel means to cause correction of said roll.

26. The combination of claim 25, said sensing means comprising mercury switch means.

* * * * *